US011396086B2

(12) United States Patent
Chen

(10) Patent No.: US 11,396,086 B2
(45) Date of Patent: Jul. 26, 2022

(54) GRINDING WHEEL CENTER HOLE PROTECTION PAD

(71) Applicant: Bay Union Abrasive Technology Co., Ltd., New Taipei (TW)

(72) Inventor: Wen-Chang Chen, New Taipei (TW)

(73) Assignee: BAY UNION ABRASIVE TECHNOLOGY CO., LTD., New Taipei (TW)

( * ) Notice: Subject to any disclaimer, the term of this patent is extended or adjusted under 35 U.S.C. 154(b) by 674 days.

(21) Appl. No.: 16/453,341

(22) Filed: Jun. 26, 2019

(65) Prior Publication Data

US 2020/0353595 A1 Nov. 12, 2020

(30) Foreign Application Priority Data

May 10, 2019 (TW) ..... 108205977

(51) Int. Cl.

| | |
|---|---|
| ***B24D 18/00*** | (2006.01) |
| ***B24D 99/00*** | (2010.01) |
| *B24D 3/02* | (2006.01) |
| *B24D 3/00* | (2006.01) |
| *B24D 11/00* | (2006.01) |
| *B24D 5/02* | (2006.01) |
| *B24D 5/10* | (2006.01) |
| *B24D 5/16* | (2006.01) |
| *B24D 7/18* | (2006.01) |
| *C09K 3/14* | (2006.01) |

(52) U.S. Cl.

CPC ..... *B24D 99/00* (2013.01); *B24D 3/001* (2013.01); *B24D 5/16* (2013.01)

(58) Field of Classification Search

USPC ..... 51/293, 308, 309

See application file for complete search history.

(56) References Cited

U.S. PATENT DOCUMENTS

| | | | | |
|---|---|---|---|---|
| 3,986,302 | A * | 10/1976 | Biardi | B24B 45/00 451/342 |
| 4,760,670 | A * | 8/1988 | MacKay, Jr. | B24D 5/16 15/230.18 |
| 4,774,788 | A * | 10/1988 | Shacham | B24D 5/16 451/342 |
| 2005/0026556 | A1* | 2/2005 | Shin | B24D 13/20 451/466 |
| 2010/0084196 | A1* | 4/2010 | Bertagnolli | C04B 37/001 175/428 |
| 2011/0017519 | A1* | 1/2011 | Bertagnolli | B22F 7/08 175/428 |
| 2012/0082520 | A1* | 4/2012 | Yeh | B24D 5/16 407/67 |

* cited by examiner

*Primary Examiner* — James E McDonough

(74) *Attorney, Agent, or Firm* — Chun-Ming Shih; HDLS IPR Services

(57) ABSTRACT

A grinding wheel center hole protection pad is provided, which mainly include a positioning portion attached to the peripheral thereof and the guiding portions disposed at the center hole at the axial center thereof. The guiding portions serve as the isolation layer between the center hole of the grinding wheel and the peripheral plate guiding wall of a flange plate. Therefore, the grinding wheel can be closely attached to the flange plate during the assembling process to decrease eccentricity. Accordingly, it is not necessary to perform the cutting calibration process and balance adjustment by a cutting machine, which can reduce the waste of manpower and material resources.

6 Claims, 7 Drawing Sheets

GRINDING WHEEL CENTER HOLE PROTECTION PAD

BACKGROUND OF THE INVENTION

1. Field of the Invention

The present invention relates to the technical field of assembling guiding wheels and flange plates; a grinding wheel center hole protection pad is provided to avoid the peripheral plate guiding wall or the grinding wheel spindle is ground by the center hole of the grinding wheel.

2. Description of the Prior Art

Grinding wheels are solid circular plates manufactured by binding abrasive materials of coarse grains via a binding agent, which can process tools by grinding via high-speed rotation. A grinding wheel should be fixed on a flange plate before being installed on a grinding wheel machine. In general, there are two types of currently available flange plates, the flat-straight type peripheral plate for rough grinding and the sleeve type peripheral plate for fine grinding. The flat-straight type peripheral plate can directly clamp the grinding wheel at the two sides of the grinding wheel; then, the grinding wheel spindle can penetrate through the flat-straight type peripheral plate and the center hole of the grinding wheel; afterwards, the grinding wheel can be directly fixed on a grinding wheel machine.

Regarding the sleeve type peripheral plate, the peripheral plate guiding wall thereof can penetrate through the center hole of the grinding wheel and then the grinding wheel can be fixed on the grinding wheel machine. However, the hardness of the grinding wheel is quite high. Besides, both of the grinding wheel spindle and the peripheral plate guiding wall of the sleeve type peripheral plate are made of metal. Therefore, when installing the grinding wheel, the peripheral plate guiding wall or the grinding wheel spindle will be ground, so a portion of the surface of the grinding wheel or the peripheral plate guiding wall will be ground off. After a period of time, the diameters of the grinding wheel spindle and the peripheral plate guiding wall will decrease, which will influence the grinding precision of the grinding wheel. In this case, it is necessary to replace the flange plate or the grinding wheel spindle.

Accordingly, it is conventionally necessary to cut the outer edge of the grinding wheel via a cutting machine to make the grinding wheel precisely be circular after assembling the grinding wheel and the flange plate. Take the grinding wheel having a center hole of 127 mm as an example, it is conventionally necessary to process the grinding wheel to make the inner diameter of the center hole thereof to be 127.2 mm. After the grinding wheel and the flange plate or the grinding wheel spindle are assembled, there will be an eccentricity of more than 0.2 mm needed to be calibrated. The present invention can effectively reduce the calibration time, and reduce the abrasion of the grinding wheel and the diameter dresser. The energy-saving effect of the present invention can be more obvious in the applications of diameter grinding wheels, CBN grinding wheels, and other grinding wheels with extra high hardness.

As described above, there are still a lot of problems of assembling grinding wheels. Accordingly, the inventor of the present invention has been involved in research into the solutions for the above problems for many years in order to solve these problems. Finally, the inventor of the present invention successfully develops a grinding wheel center protection pad capable of solving these problems.

SUMMARY OF THE INVENTION

One object of the present invention is to provide a grinding wheel center protection pad for conveniently assembling the peripheral plate guiding wall of a flange plate or a grinding wheel spindle with a grinding wheel so as to avoid that the peripheral plate guiding wall or the grinding wheel spindle is abraded by the center hole of the grinding wheel.

Another object of the present invention is to provide a grinding wheel center protection pad capable of reducing the abrasion of a grinding wheel and a diamond dresser during the cutting calibration process of the grinding wheel, which can more obviously decrease the excessive abrasion of diameter dressers in the applications of diameter grinding wheels, CBN grinding wheels, and other grinding wheels with extra high hardness.

Still another object of the present invention is to provide a grinding wheel center protection pad capable of absorbing the thermal expansion generated from flange plates or grinding wheel spindles during the grinding processes of grinding wheels via its own flexible material characteristic in order to maintain the precision of precision machining processes.

Still another object of the present invention is to provide a grinding wheel center protection pad capable of maintain the concentricity of an old grinding wheel after the grinding wheel is installed on a machine again after having been used in a machining process and replaced. In other words, the grinding wheel can directly be installed on a machine and used again without calibration.

To achieve the foregoing objects, the present invention provides a grinding wheel center protection pad, which mainly includes a positioning portion and a plurality of guiding portions. The positioning portion is annular shaped, and centered coaxially with the center of the grinding wheel. The guiding portions are equidistantly or non-equidistantly disposed on the inner ring surface of the positioning portion. One end of the guiding portions is connected to the inner ring surface of the positioning portion. The other end of the guiding portions is connected to the inner ring surface and extends into the hole opened at the axial center of the grinding wheel.

Preferably, the guiding portions are perpendicular to or almost perpendicular to the positioning portion.

Preferably, the surface, facing the one surface of the grinding wheel, of the positioning portion is a bonding surface. The surface, facing one side of the wall surface of the center hole of the grinding wheel, of the guiding portions is a contact surface. The other surface, opposite to the contract surface, of the guiding portions is a smooth surface.

BRIEF DESCRIPTION OF THE DRAWINGS

For a better understanding of the aforementioned embodiments of the invention as well as additional embodiments thereof, reference should be made to the Description of Embodiments below, in conjunction with the following drawings in which like reference numerals refer to corresponding parts throughout the figures.

DETAILED DESCRIPTION OF THE PREFERRED EMBODIMENT

The following description is about embodiments of the present invention; however it is not intended to limit the scope of the present invention.

Figure 1:
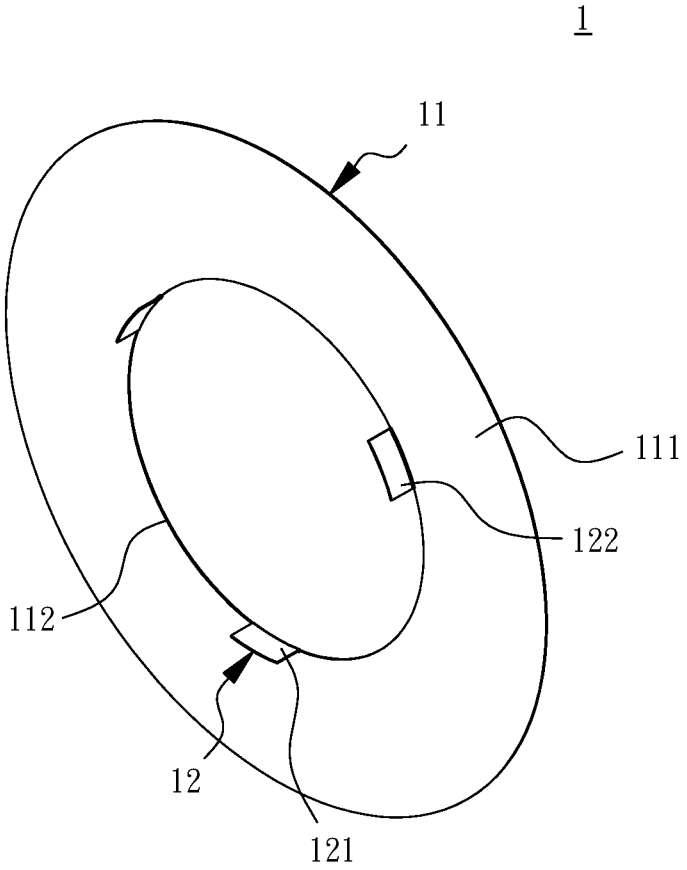
FIG. 1 is a perspective view of a grinding wheel center protection pad in accordance with a preferred embodiment of the present invention.
Figure 2:
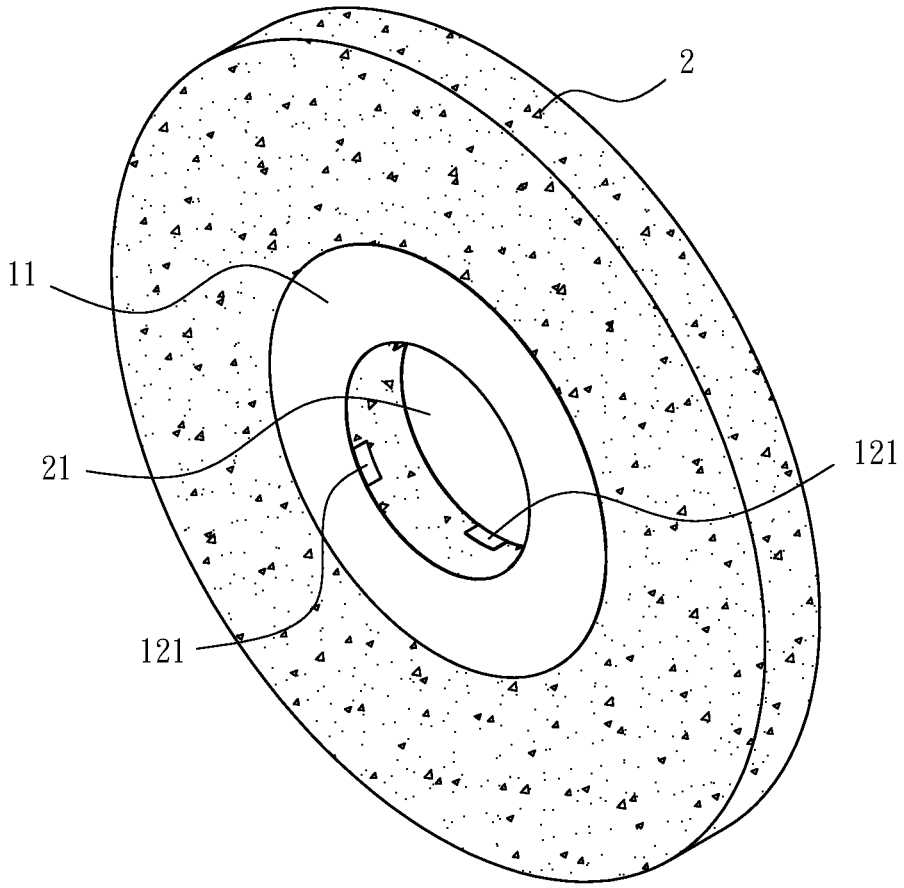
FIG. 2 is a perspective view of the combination of a grinding wheel center protection pad with a grinding wheel in accordance with a preferred embodiment of the present invention.
Figure 3:
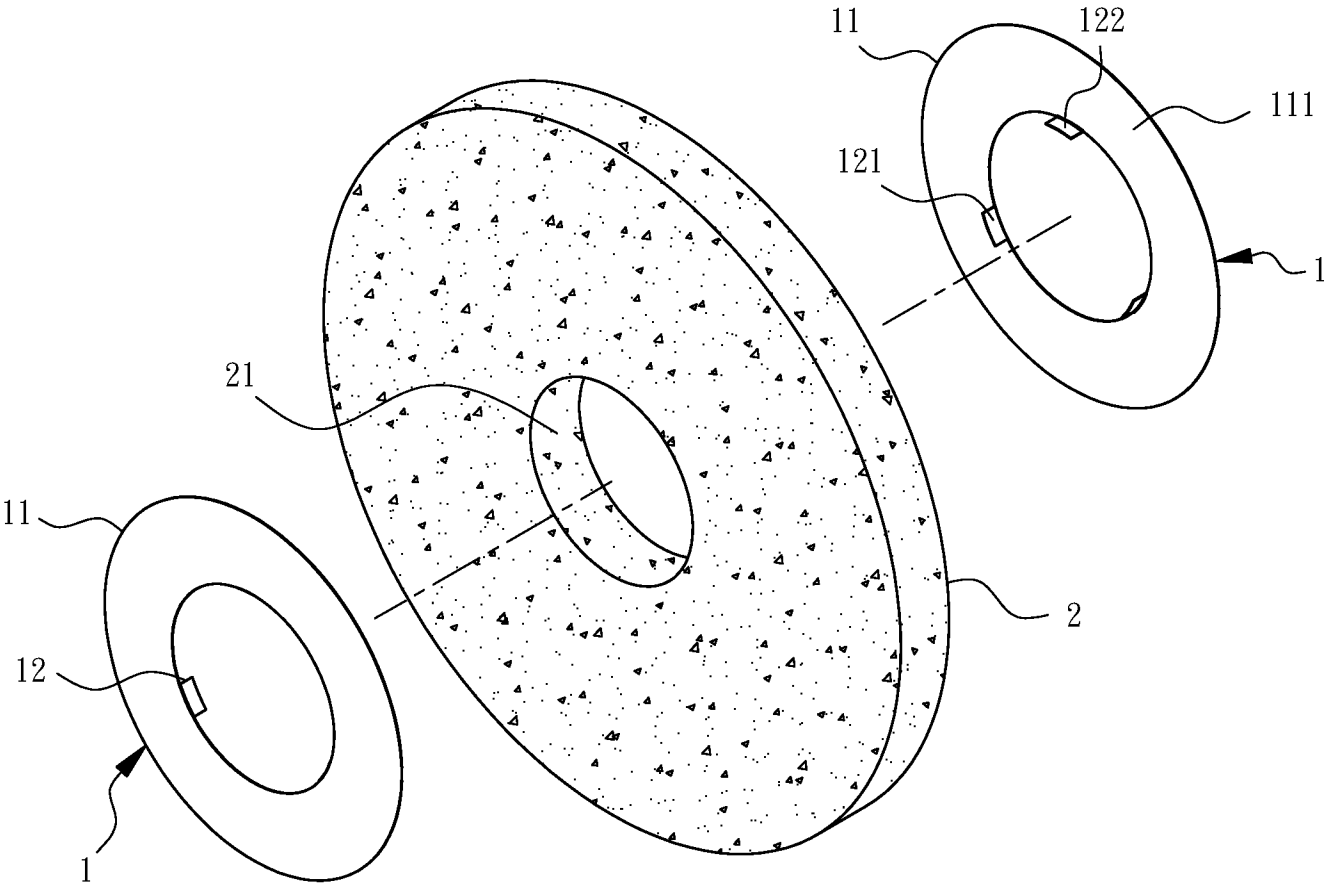
FIG. 3 is an exploded view of the combination of a grinding wheel center protection pad with a grinding wheel in accordance with a preferred embodiment of the present invention.
Figure 4:
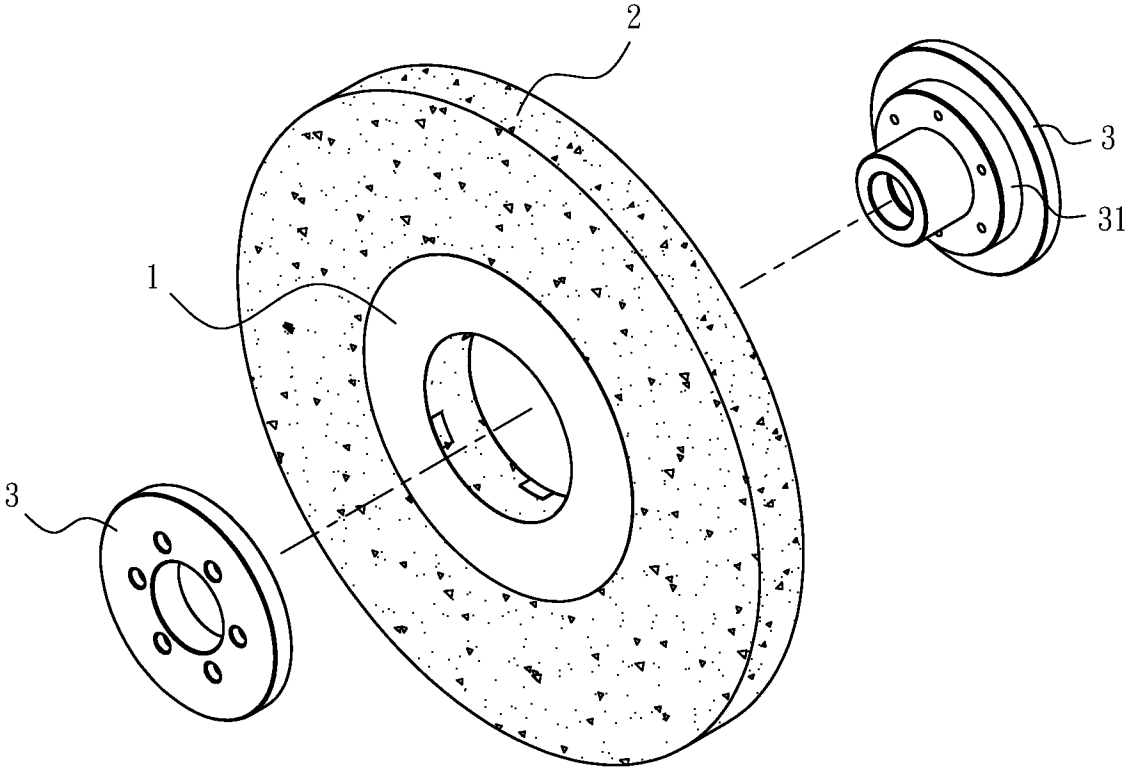
FIG. 4 is an exploded view of the combination of a grinding wheel center protection pad and a grinding wheel with a flange plate in accordance with a preferred embodiment of the present invention.
Figure 5:
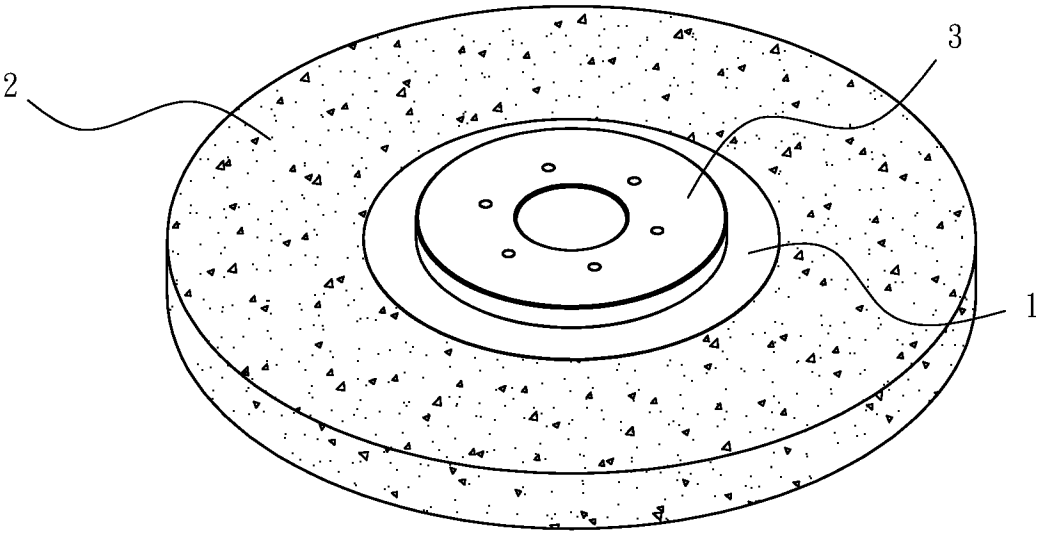
FIG. 5 is a perspective view of the combination of a grinding wheel center protection pad and a grinding wheel with a flange plate in accordance with a preferred embodiment of the present invention.
Figure 6:
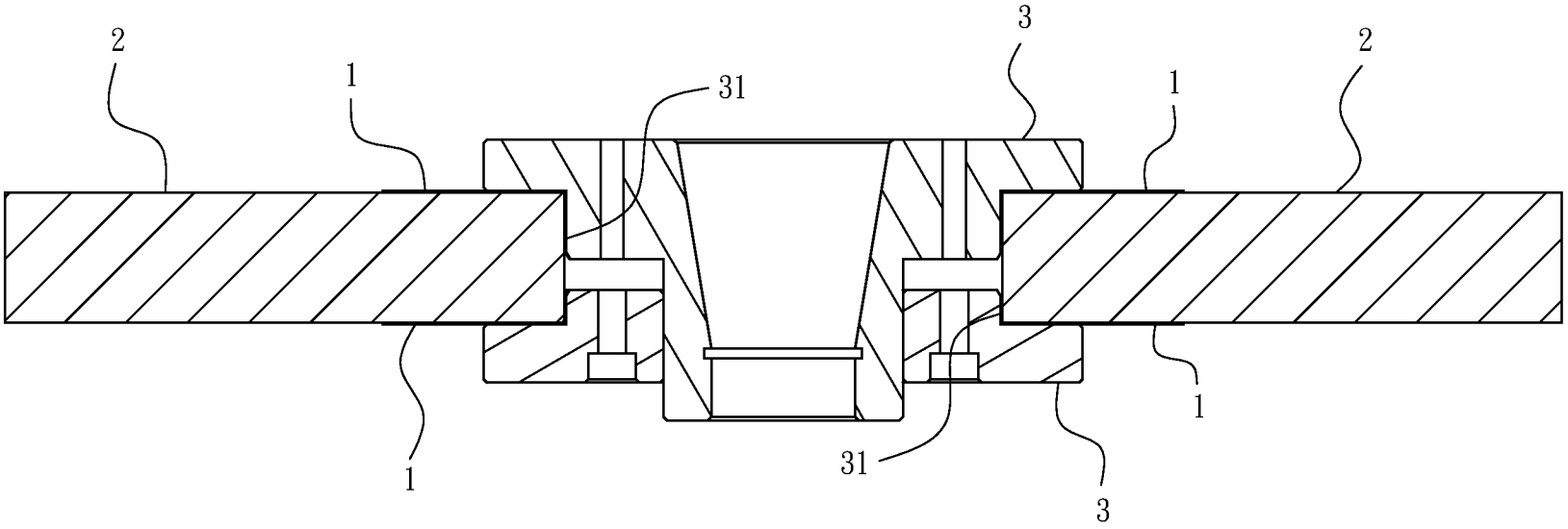
FIG. 6 is a sectional view of the combination of a grinding wheel center protection pad and a grinding wheel with a flange plate in accordance with a preferred embodiment of the present invention.
Figure 7:
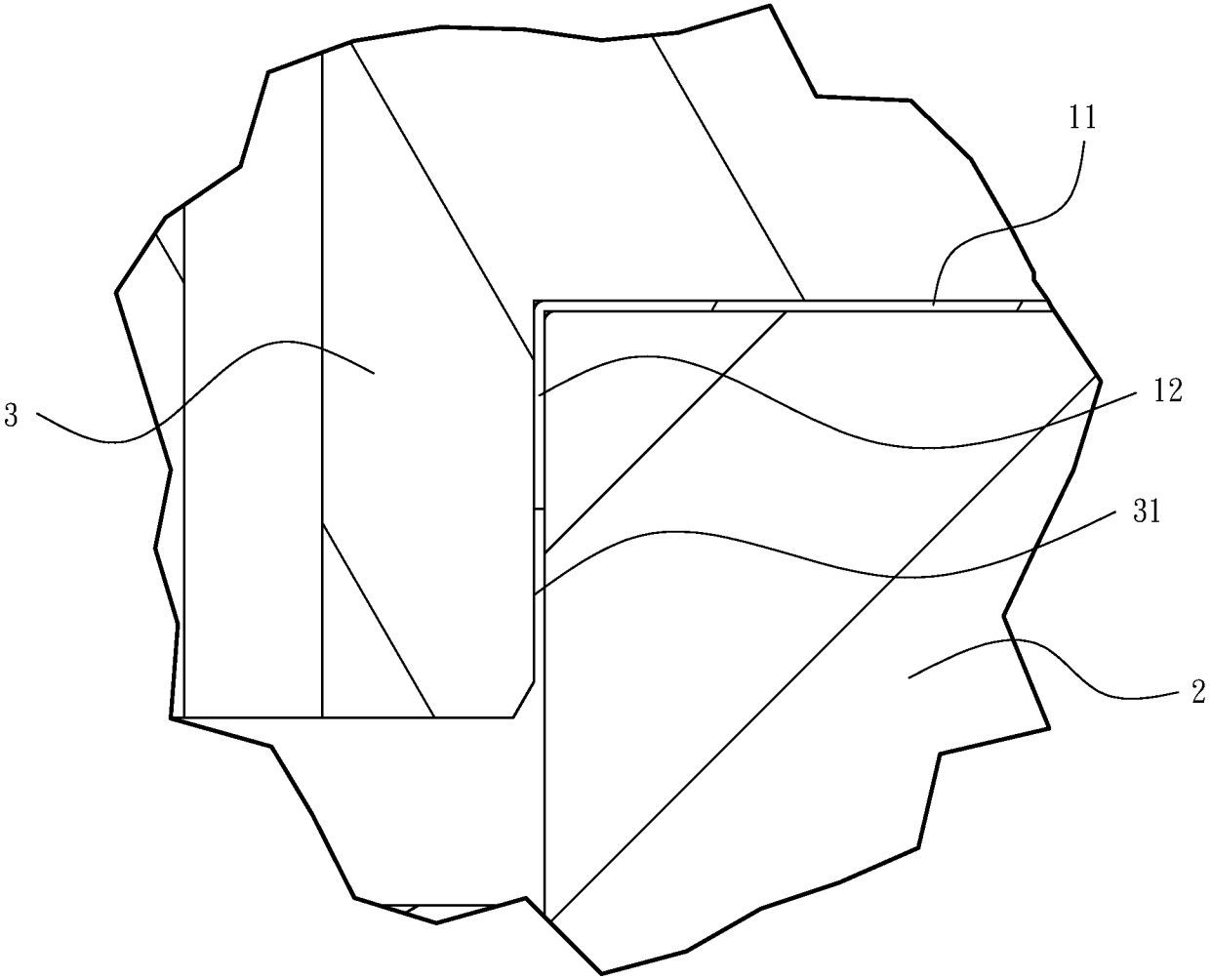
FIG. 7 is a partial enlargement view of FIG. 6.

Please refer to FIG. 1-FIG. 7, the grinding wheel center hole protection pad 1 is mainly disposed at the two sides of the grinding wheel 2. Thus, each grinding wheel 2 needs two grinding wheel center hole protection pads 1. Each grinding wheel center hole protection pad 1 includes a positioning portion 11 and three guiding portions 12. More specifically, the positioning portion 11 is centered coaxially with the center of the grinding wheel 2. One surface of the positioning portion 11 is a bonding surface 111 and the positioning portion 11 is annular shaped, and the diameter of the inner ring 112 of the positioning portion 11 is equal to the diameter of the center hole 21 opened at the axial center of the grinding wheel 2.

The three guiding portions 12 are equidistantly disposed on the surface of the inner ring 112 of the positioning portion 11. Besides, one end of each guiding portion 12 is connected to the surface of the inner ring 112 of the positioning portion 11. The other end, opposite to the end connected to the positioning portion 11, of each guiding portion 12 extends in the direction of the bonding surface 111 of the positioning portion 11. Moreover, the surface, facing the center of the positioning portion 11, of each guiding portion 12 is a smooth surface 121, and the other surface, opposite to the smooth surface 121, of each guiding portion 12 is a contact surface 122.

When using the grinding wheel center hole protection pad 1 provided by the present invention, the user can attach the bonding surfaces 111 of the positioning portions 11 of two grinding wheel center hole protection pads 1 to the surface of the grinding wheel 2 from the two sides of the grinding wheel 2. Meanwhile, the user can make the guiding portions 12 penetrate into the center hole 21 opened at the axial center of the grinding wheel 2, and then attach the contact surfaces of the guiding portions 12 to the wall surface of the center hole 21 of the grinding wheel 2.

When assembling the grinding wheel 2 with the grinding wheel center hole protection pads 1 provided by the present invention with a flange plate 3 or a grinding wheel spindle (not shown in the drawings), and the peripheral plate guiding wall 31 of the flange plate 3 or the grinding wheel spindle penetrates through the center hole 21 of the grinding wheel 2, the peripheral plate guiding wall 31 or the grinding wheel spindle will be guided by the smooth surfaces 121 of the guiding portions 12 to enter the center hole 21 of the grinding wheel 2 and then press against the guiding portions 12. In this way, the grinding wheel 2 can closely engage with the flange plate 3 or the grinding wheel spindle because the guiding portions 12 are made of flexible paper or plastic materials. In addition, the guiding portions 12 can provide the isolation effect when the peripheral plate guiding wall 31 or the grinding wheel spindle penetrates into the center hole 21 of the grinding wheel 2 due to the thickness of the guiding portions 12. Thus, the peripheral plate guiding wall 31 or the grinding wheel spindle will not directly contact the center hole 21 of the grinding wheel 2. Therefore, the grinding wheel 2 can closely engage with the flange plate 3 or the grinding wheel spindle without abrading the peripheral plate guiding wall 31 or the surface of the grinding wheel spindle.

Further, as the cutting calibration of a currently available grinding wheel 2 is usually greater than 0.2 mm after a cutting calibration process, the grinding wheel 2 will be abraded before using the grinding wheel 2. The aforementioned cutting calibration is acceptable for normal grinding wheels, but is not acceptable for diamond grinding wheels because which will incur a lot of loss in cost. On the contrary, the grinding wheel center hole protection pad 1 provided by the present invention can achieve great eccentricity between the grinding wheel and the flange plate/grinding wheel spindle without the cutting calibration process, which can effectively reduce the loss in cost.

Moreover, in order to successfully assemble the flange plate with the grinding wheel spindle, the inner diameter of the center hole of a currently available grinding wheel is greater than the flange plate or the outer diameter of the grinding wheel spindle. However, the above structure will decrease eccentricity when assembling the grinding wheel. Although the above problem can be improved by implementing balance adjustment latter, the grinding process of the grinding wheel 2 will generate a large amount of thermal energy during the grinding process and then result in thermal expansion of the flange plate 3 or the grinding wheel spindle. Therefore, the grinding wheel 2 will be forced to press against one side of the flange plate 3 or the grinding wheel spindle, which will influence the processing precision of the grinding wheel 2. On the contrary, via the guiding portions 12, the present invention can make the center hole 21 of the grinding wheel 2 closely engage with the flange plate 3 or the grinding wheel spindle. Besides, as the main bodies of the guiding portions 12 are flexible, so can absorb the thermal expansion generated from the flange plate 3 or the grinding wheel spindle during the grinding process. Accordingly, the grinding wheel can still achieve great precision when being applied to high-precision machining process.

Furthermore, during the grinding process, it may need to replace the grinding wheel in use by another type of grinding wheel to grind a tool. Conventionally, it is necessary to re-perform balance adjustment. On the contrary, as the eccentricity of the grinding wheel with the grinding wheel center hole protection pad according to the present invention will not change even if being replaced, so the grinding wheel can be directly used without balance adjustment, which can effectively save the time for performing balance adjustment.

The above disclosure is related to the detailed technical contents and inventive features thereof. Those skilled in the art may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A grinding wheel center hole protection pad, positioned on two sides of the grinding wheel, mainly comprises:

an annular shaped positioning portion centered coaxially with the center of the grinding wheel;

a plurality of guiding portions, with one end of the guiding portions connected to the inner ring surface of the positioning portion, and the other end of the guiding portions connected to the inner ring surface extending into the hole opened at the axial center of the grinding wheel.

2. The grinding wheel center hole protection pad of claim 1, with the positioning portion facing the one surface of the grinding wheel as a bonding surface, the guiding portion facing one side of the wall surface of the grinding wheel center hole as a contact surface, the bonding surface attached on the side surface of the grinding wheel, and the contact surface attached to the wall surface of the center hole of the grinding wheel.

3. The grinding wheel center hole protection pad of claim 1, with the guiding portions equidistantly disposed on the inner ring surface of the positioning portion.

4. The grinding wheel center hole protection pad of claim 1, with the guiding portions made of elastic paper or plastic materials.

5. The grinding wheel center hole protection pad of claim 1, with the guiding portions facing the center of the center hole of the grinding wheel as a smooth surface.

6. The grinding wheel center hole protection pad of claim 1, with the guiding portions perpendicular to the positioning portion.

* * * * *